United States Patent [19]

Periou

[11] Patent Number: 4,802,350

[45] Date of Patent: Feb. 7, 1989

[54] ASSEMBLY OF A DOOR LATCH AND ANTI-THEFT AND ANTI-ATTACK DEACTIVATING DEVICE FOR SAID LATCH, AND LATCH WHICH IS PART OF SAID ASSEMBLY

[75] Inventor: Pierre Periou, Cergy Pontoise, France

[73] Assignee: Rockwell-CIM, France

[21] Appl. No.: 185,638

[22] Filed: Apr. 25, 1988

[30] Foreign Application Priority Data

Apr. 29, 1987 [FR] France ..... 87 06131

[51] Int. Cl.[4] ..... E05B 53/00

[52] U.S. Cl. ..... 70/264; 292/201; 292/216

[58] Field of Search ..... 70/264, 263, 241, 240; 292/201, 216, 280, 144, 210, DIG. 25, , DIG. 26, DIG. 27

[56] References Cited

U.S. PATENT DOCUMENTS

| | | | |
|---|---|---|---|
| 3,620,560 | 11/1971 | Peters | 292/201 |
| 3,624,298 | 5/1972 | Strophay | 292/201 |
| 3,917,330 | 11/1975 | Quantz | 292/216 |
| 4,268,076 | 5/1981 | Itoi | 292/216 |
| 4,342,209 | 8/1982 | Kleefeldt | 70/264 |
| 4,624,491 | 11/1986 | Vincent | 292/201 |
| 4,667,990 | 5/1987 | Quentz | 292/201 |
| 4,669,283 | 6/1987 | Ingenhoven | 70/264 |

*Primary Examiner*—Robert L. Wolfe

[57] ABSTRACT

The latch comprises a keeper (2), a fork member (3) provided with two branches (7, 8) for retaining the keeper (2), a catch (9) movable to a position for locking the fork member (3) on the keeper (2), and a control lever (12) for the catch (9) for unlocking the fork member (3). The lever (12) is connected to an outer or inner opening control (13, 14) and is associated with an electric deactivating circuit comprising switches (25, 26) and an electromechanism so arranged that an attempt to open in an unauthorized manner after the deactivation of the door causes the closure of one of the switches (25, 26) and the supply of current to the electromechanism which automatically releases the lever (12) from the catch (9) and prevents the unlocking of the latch by the catch. In the event of a breakdown of the supply battery, the lever (12) remains coupled to the catch (9) and permits the opening of the door. FIG. 1.

11 Claims, 4 Drawing Sheets

FIG. 3
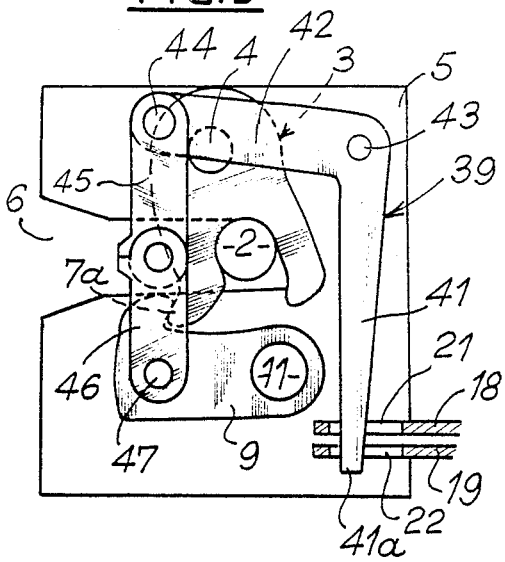
FIG. 5
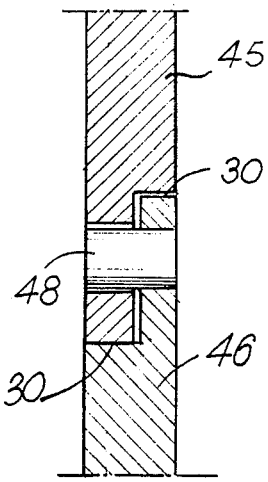
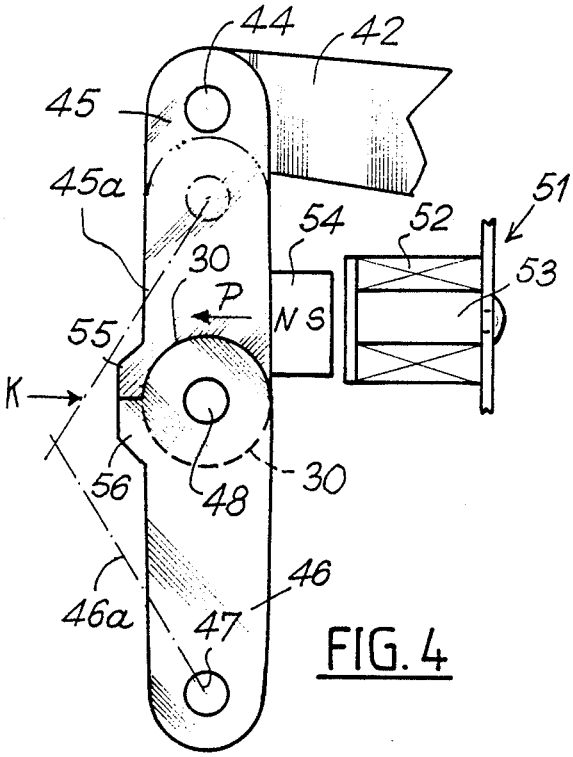
FIG. 4

ASSEMBLY OF A DOOR LATCH AND ANTI-THEFT AND ANTI-ATTACK DEACTIVATING DEVICE FOR SAID LATCH, AND LATCH WHICH IS PART OF SAID ASSEMBLY

The present invention relates to an assembly of a door latch and a device for deactivating said latch, in particular for a motor vehicle door, and the latch which is part of this assembly.

The invention is more generally applicable to any latch or closing device of an opening element of the aforementioned type, the term "door" being employed hereinafter as synonymous with the opening element for convenience of description.

The latch to which the invention relates is of the type comprising a keeper fixed on a frame of the door, a fork member pivotally mounted in a latch case in which is formed an opening for receiving the keeper, said fork member being provided with two branches for retaining the keeper therebetween, a catch pivotally mounted on the latch case and movable to a position for locking the fork member on the keeper and maintaining the door closed, catch shifting means for locking and unlocking the fork member and capable of being rendered inoperative by a deactivating device.

In known latches, there is increasingly provided a central electromechanical control for a latch actuated by a key and equipped with electric contacts whereby it is possible to deactivate or reactivate all of the doors from the exterior, and in particular the exterior of a vehicle.

There may be associated with this key-actuated lock (or even replacing it), a coded remote control employing an infra-red ray or Hertzian waves which performs the same function.

In both cases, access to the vehicle is validated by coincidence of a code (key or remote control).

These known latches are also provided with a switch located inside the vehicle and controlling the deactivation of the exterior controls of the vehicle and preventing an attack on the occupants of the vehicle. Generally, the rear doors of motor vehicles further comprise a device termed "child safety" device, for also rendering the interior controls of these doors inoperative.

It should be noted that in the known latches, the reactivation of at least one door of the vehicle from the exterior must be easily achieved to permit coming to the aid of the occupants in the event of accident after breaking a window glass and achieving the reactivation. Now, this requirement also renders the tampering of the deactivating system more easy.

Improved devices have therefore been imagined, in which the anti-attack deactivation is achieved as explained above, by merely the deactivation of the exterior controls, but in which the anti-theft deactivation of the vehicle renders inoperative the control of the interior reactivation, or the exterior opening controls, or both thereof.

It will be understood that in these improved devices there is a risk of a major breakdown in the event of failure of the supply battery, or of the electronic control device of the electromechanical control system. This risk must be all the more taken into account as in these devices, very special care has been taken in the latches themselves to prevent the picking of these latches.

Various remedies have been proposed, such as for example a mechanical safety lock on one of the doors, a safety battery, etc. but, apart from the fact that these remedies represent additional equipment cost, none of them has given real satisfaction.

An object of the invention is therefore to provide an assembly of a latch and a deactivating device which provides a solution of this problem in the event of failure of the supply battery.

According to the invention, in the assembly of latch and the deactivating device therefor:

the catch shifting means comprise a lever connected to at least one manual control system for said lever, to permit the shifting of the catch and the locking of the latch, and an electromechanism capable of maintaining the control lever coupled in rotation with the catch so long as said electromechanism is not carrying electric current, and releasing the lever from the catch when it is supplied with current;

the deactivating device comprises a centralized electric control circuit associated with the manual control system for the lever, and in which are disposed at least one switch capable of being closed by an approach travel of said control system, and the electromechanism, which is provided with means for automatically releasing the lever relative to the catch, actuated after activation of the deactivating circuit by a closure of the switch which results in a supply of current to the electromechanism, means for automatically producing said closure of the switch by a manual attempt to actuate the control system of the lever.

It will be understood that, in the absence of current in the electromechanism, the latch is predisposed to be opened from either the exterior or the interior in the case of a vehicle door provided with two manual opening control systems.

If, by means of the central control device the switch associated with the exterior opening control system is actuated (anti-attack switch) by supplying it with current, and if the exterior opening control is actuated, this actuation results in the automatic closure of the switch, and consequently the supply of current to the electromechanism, which automatically releases the lever from the catch, and thus renders inoperative the attempt to shift said catch. The attempt to attack the occupant of the vehicle by the opening of the doors is therefore thwarted and the latch remains locked.

In a possible second embodiment of the assembly of the invention, the second switch associated with the interior opening control operates in the same way when it is actuated by manually supplying current to an anti-theft switch of the central control device.

According to one embodiment, the assembly of the invention comprises two manual control systems for the lever, which are exterior or interior relative to the door and each provided with a slide in which is formed an elongated opening through which an end of the control lever of the catch extends, and each end of the slides cooperates with a respective exterior control switch and interior control switch arranged in such manner that, in the position of rest of the slides, the switches are open and no current is consequently supplied to the electromechanism which therefore maintains the control lever coupled in rotation with the catch and that actuation of one of the slides causes the closure of the corresponding switch, and consequently, if this switch is actuated, the automatic release by the electromechanism of the control lever relative to the catch, it being then no longer possible to open the latch.

According to another feature of the invention, the electric circuit of the deactivating device comprises, connected to a source of direct current: a first anti-theft reversing switch capable of being closed by a control means such as a manual coded key or a remote control, an anti-theft deactivating relay, a second anti-attack switch and an anti-attack relay, the exterior control switch, the electromechanism, all these elements being connected in series and the electromechanism being connected, on one hand, to the exterior control switch and, on the other hand, with the anti-attack relay, which may be supplied with current by means of the anti-theft relay when a coil of the latter is not supplied with current and the anti-attack switch is actuated.

When the user of the vehicle chooses the anti-attack deactivation, the actuation of the anti-attack switch causes the deactivation of the systems for the exterior opening control of the front and rear doors. If the user chooses the anti-theft deactivation, the supply of current to the anti-theft deactivating switch causes the deactivation of the interior and exterior opening control systems for both the front and rear doors of the vehicle.

The deactivating device and the corresponding latch provided by the invention permit the opening of the doors of the vehicle in the event of a complete breakdown of the supply battery. Indeed, in this case, as the electromechanism is not supplied with current, it cannot release the control lever from the catch, and the latch consequently remains predisposed to be opened. However, the probability of an attempt to steal the vehicle in such a case is extremely low since nothing indicates that said system is in the state of complete breakdown.

Further features and advantages of the invention will be apparent from the following description with reference to the accompanying drawings which illustrate two embodiments thereof by way of non-limitative examples:

FIG. 3 is a simplified elevational view of a second embodiment of the latch according to the invention, shown in its locked and deactivated position;

FIG. 4 is a partial side elevational view, to an enlarged scale, of the latch of FIG. 3;

FIG. 5 is partial end elevational view in the direction of arrow K of the latch of FIG. 4;

FIGS. 1 and 2 show a latch 1 which may be employed on any door, in particular a motor vehicle door, and more particularly a front door (not shown). It will be described hereinafter in its use on a front door of the vehicle, for convenience of description.

Figure 1:
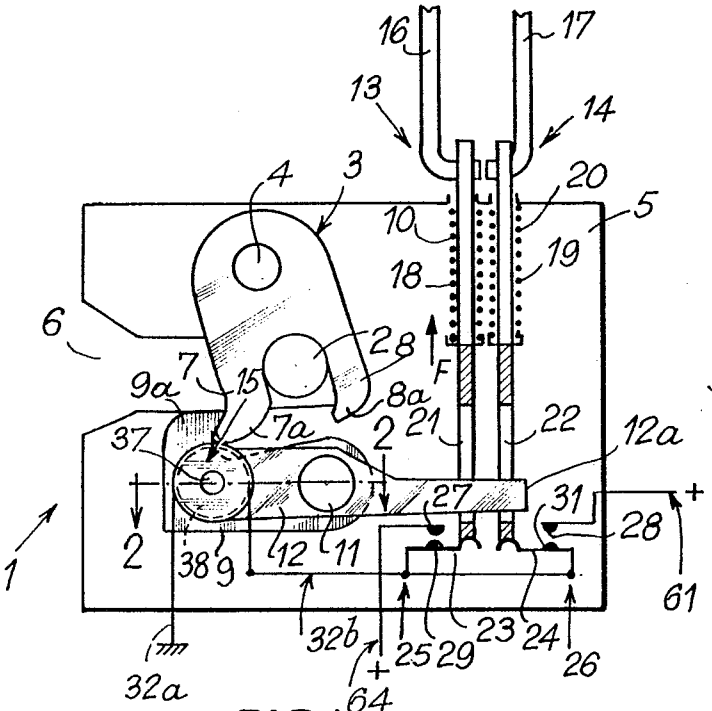
FIG. 1 is a simplified elevational view of a first embodiment of the latch according to the invention, partly showing its exterior and interior opening control systems, the latch being locked and deactivated.

This latch 1 comprises a keeper 2 fixed to a frame of the door, a fork member 3 pivotally mounted on a pin 4 on a case 5 of the latch, there being provided in this fork member an opening 6 for receiving the keeper 2. The fork member 3 is provided with two branches 7, 8 for retaining the keeper 2 therebetween, as shown in FIG. 1 in which the latch is locked.

Each branch 7, 8 is provided with an end nose portion 7*a*, 8*a* and, when the latch is locked, the nose portion 7*a* cooperates with the corresponding nose portion 9*a* of a locking catch 9 pivotally mounted on a pin 11 carried by the case 5. The fork member 3 is maintained in the locked position on the keeper 2 by the catch 9 so long as the latter is in this position.

This latch device further comprises means for shifting the catch 9 which comprises a lever 12 connected to two manual control systems 13, 14 for this lever 12, respectively for the exterior control and the interior control of the door. Each opening control 13, 14 is provided with a rod 16, 17 associated, by means not shown, with the exterior and interior door opening knobs, and a slide 18, 19 one end of which is fixed to a corresponding end of the rod 16, 17.

An elongated opening 21, 22 is provided in the end of the slide 18, 19 remote from the rod 16, 17. Engaged in these two openings 21, 2 is one end portion 12*a* of the lever 12 and, in its position of rest (FIG. 1), each end of the slide 18, 19 contiguous with the end portion 9*a* of the lever 12 is in contact with an elastically yieldable tab 23, 24 of a respective switch 25, 26 which comprises a fixed stud 27, 28 for contact with a corresponding stud 29, 31 of the tabs 23, 24.

Each switch 25, 26 is part of a central electric circuit for controlling the anti-theft and anti-attack deactivating system shown in FIGS. 7 and 8 and described hereinafter.

The slides 18,19 extend through respective coil springs 10, 20 and the case 5, the springs bearing against the case 5 for biasing the slides to a position of rest seen in FIG. 1 in which they maintain the switches 25, 26 open.

The lever 12 is pivotally mounted on the case 5 on the same pin 11 as the catch 9. The electromechanism 15 comprises a coil 32, connected to the central electric circuit through connections 32*a*, 32*b*, and in which is axially slidable a plunger 33. The lever 12 and the catch 9 are provided, in facing relation to the axis of the coil 15 and the plunger 13 and in alignment with each other, with two openings 34, 35, in which plunger 33 is maintained by a return spring 36 inside the coil 32 and bearing against a cap 37 capping a support 38 of the coil 32.

When the coil 32 is not supplied with current, the spring 36 maintains the plunger 33 in the openings 34, 35, and consequently the lever 12 coupled in rotation with the catch 9 about the pin 11. On the other hand, if the coil 32 is supplied with current subsequent to the closure of one of the switches 25, 26 (as will be explained in detail with reference to FIG. 7), this supply of current will cause the retraction of the plunger 33 within the coil 32, and consequently the release of the lever 12 from the catch 9.

Figure 2:
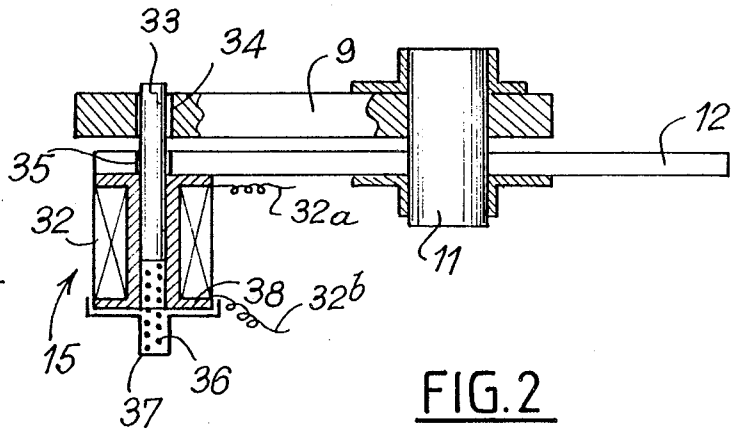
FIG. 2 is a cross-sectional view taken on line 2—2 of FIG. 1.
Figure 7:
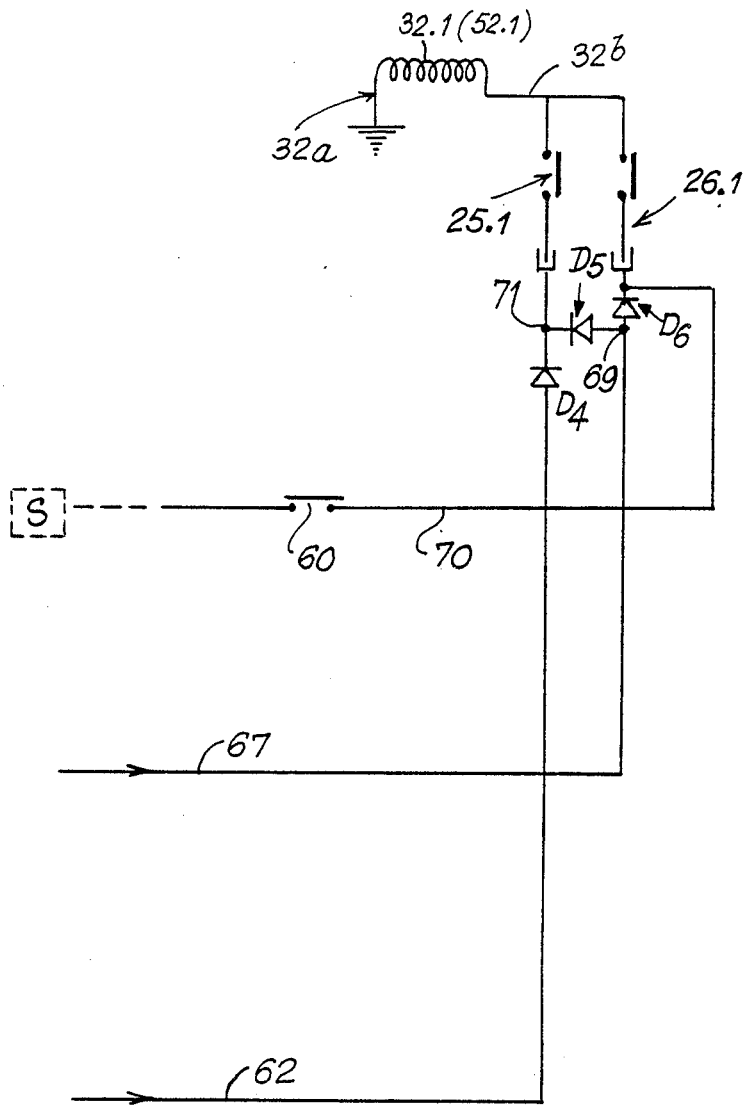
FIG. 7 is an electric diagram of a deactivating device which completes that of FIG. 6 for the anti-attack and anti-theft deactivation of a rear door of a vehicle.

In order to render the operation of the latch assembly and the deactivating device according to the invention more clear, the operation of the device shown in FIGS. 1 and 2 will first of all be described, followed by the description of the operation of the corresponding electric deactivating circuit of FIGS. 7 and 8.

Operation of the latch and deactivating elements of FIGS. 1 and 2

With the latch 1 closed or locked by the catch 9, the slides 18, 19 and the switches 25, 26 are in the illustrated position of rest in which none of the exterior and interior controls of the door is actuated.

If the user depresses a button for closing the anti-theft switch of the central deactivating device, the switch 25 is activated by the supply of current. If thereafter a person attempts to open the door by actuating the exterior control associated with the rod 16 and the slide 18, the latter is driven in the direction of arrow F by the rod 16 against the return force exerted by the spring 10. This movement of the slide 18 therefore closes the contact 25 whose stud 29 is applied against the stud 27 and correlatively causes the supply of current to the coil 32, by the DC source of current to which the electric locking circuit is connected. The plunger 33 is then automatically retracted from the openings 34, 35 and the lever 12 is released from the catch 9. The slide 18, in pursuing its travel, then drives the lever 12 in rotation about the pin 11, this lever being no longer capable of driving the catch 9, so that the latch 1 remains locked and the attempt to attack is thwarted.

When the exterior control of the door ceases to be actuated, the spring 10 automatically returns the slide 18 to its initial position and consequently opens the switch 25. As the coil 32 is no longer supplied with current, the spring 36 returns the plunger 33 into the openings 34, 35 and recouples in rotation the catch 9 with the lever 12.

If the user chooses the "anti-theft" mode of utilization of the central locking device, an attempt to open the door by either one one of the exterior and interior controls, and consequently by pulling on either one of the rods 16 and 17, results in the same sequence of operation as that described hereinbefore, the slide 19 being returned to its initial position by its return spring 20.

Second embodiment of the latch (FIGS. 3 to 5)

In this embodiment, the lever 39 controlling the catch 9 has two branches 41, 42 substantially in an L shape and is pivotally mounted at the junction of these branches on a pin 43 mounted on the case 5. One end, 41*a*, of the branch 41 is engaged in the openings 21, 22 of the slides 18, 19 while the second branch 42 is rotatively mounted at its end on a pin 44 carried by the first, 45, of two links 45, 46. The second link 46 is pivotally mounted on the catch 9 by a pin 47 at the end thereof remote from the pin 44. The two links 45, 46 are articulated together by a pin 48. The part of the end portions of the links 45, 46 in the vicinity of the pin 48 and facing toward the electromechanism 51 has a radiused portion 30 to permit the articulation of the links 45, 46. Note that each link 45, 46 is provided at the end thereof in the vicinity of the pin 48 opposed to the electromechanism 51, with an end enlargement 55, 56 these two enlargements being in mutual abutment with each other when the links 45, 46 are in the extension of each other. The links are maintained in this position by the magnet 54 which is indeed attracted by the magnetic core 53. The links 45 and 46 thus constitute a toggle capable of being opened at the articulation of the two links 45, 46 at the pin 48.

The electromechanism 51 (FIG. 4) comprises a coil 52 containing a magnetic core 53 and a magnet 54 fixed to one of the links 45, 46, namely the link 45 in the presently-described embodiment, in alignment with the core 53 and at a short distance from the latter.

This mechanism having a toggle 45, 46 operates in the following manner:

At rest, with none of the controls for opening the door being actuated, the device is in the condition shown in FIGS. 3 and 4: the two links 45 and 46 are in the extension of each other on each side of their articulation pin 48 owing to the fact that the coil 52 is not supplied with current and the magnet 54 is attracted by the core 53.

If now, after activation of the anti-attack or anti-theft deactivating device, there is an attempt to open one of the controls of the door, the switch 25 or 26 associated with this control closes, the coil 52 is supplied with current and the magnet 54, repulsed by the core 53, exerts a thrust P on the link 45. This thrust causes the link 45 to swing about its pivot pin 44 and drives the pin 48 about which the two links 45, 46 pivot, the link 46 also pivoting about its pivot pin 47 on the catch 9. At the end of this pivoting, the links 45, 46 come to occupy a position in a V shape symbolically represented by the dot-dash lines 45*a*, 46*a*, so that the operative connection (FIG. 3) between the arm 42 and the catch 9 is broken (FIG. 4). Consequently, the pivoting of the lever 39 driven by the displacement of the slide 18 or 19, remains without effect on the catch 9 which remains in the position for locking the fork member 3 and the latch cannot be opened.

Now, if as a result of a breakdown of the battery the electric deactivating circuit is no longer supplied with current after the latch has been locked and deactivated, either in the anti-theft mode or in the anti-attack mode, no current passes through the coil 52 when the exterior control or interior control for opening the door is actuated. Consequently, the toggle 45, 46 remains in the position thereof shown in FIG. 3 in which the links 45, 46 are located in the extension of each other and are capable of transmitting to the catch 9 the rotation of the control lever 39. This permits the unlocking of the fork member 3 and therefore the opening of the latch and of the door.

Thus, in the two embodiments of the latch and its actuating means described with reference to FIGS. 1 to 5, a complete breakdown of the battery of the vehicle occurring after the anti-theft or anti-attack deactivation of the doors, nonetheless permits the user to open the doors of the vehicle. This result therefore constitutes an essential advantage of the invention over known structures in that the user of the vehicle is guaranteed to be in a position to enter the vehicle after the deactivation of the doors, and in the event of a complete breakdown of the battery.

Figure 6:
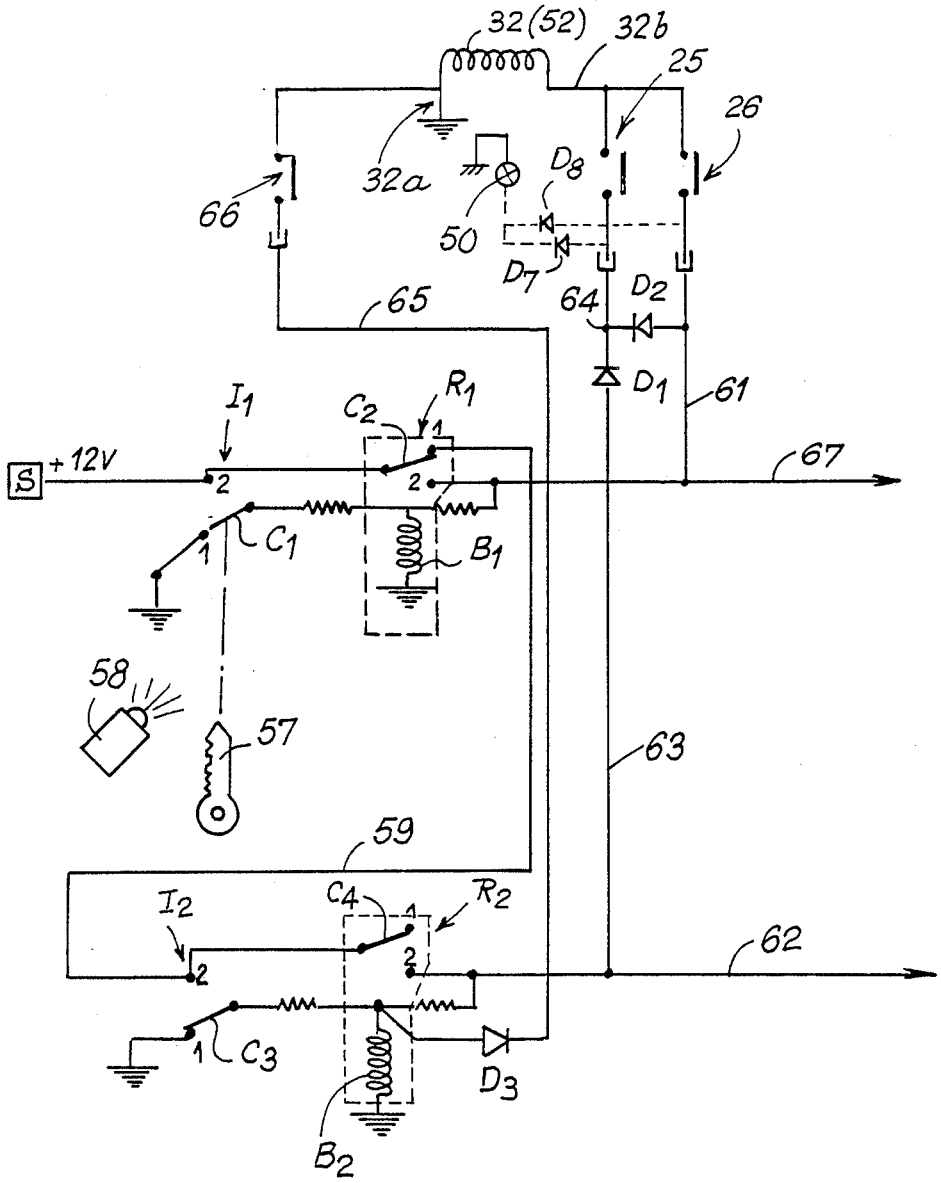
FIG. 6 illustrates an embodiment of an anti-theft and anti-attack electric deactivating circuit adapted to cooperate with a latch according to one of the aforementioned embodiments.

Description of the electric deactivating circuit (FIGS. 6 and 7)

The circuit shown in FIG. 6 permits the anti-theft or anti-attack deactivation of a vehicle door, preferably a front door, while the complementary circuit shown in FIG. 8 ensures, in addition to the anti-theft or anti-attack deactivation, a "child safety" deactivation and is therefore particularly adapted to the rear door of the vehicle.

The circuit shown in FIG. 6 comprises, connected to a DC source S, for example a 12 Volt vehicle battery, a first anti-theft reversing switch I1, an anti-theft deactivating relay R1, a second anti-attack reversing switch I2 associated with a control button inside the passenger compartment of the vehicle, and an anti-attack relay R2, the switch associated with the exterior opening control 25, the switch associated with the interior opening control 26, and the coil 32 (or 52) of the electromechanism. The reversing switch I1 can be actuated by a control means such as a coded manual key 57, or a infra-red or Hertzian wave remote control 58.

The switch 26 is connected, in parallel with the switch 25, on one hand to the coil 32 (52), and on the other hand to the anti-theft relay R1, the other aforementioned elements being connected in series. In its position of rest 1, the moving contact C1 of the reversing switch I1 is connected to ground and, in its operative position 2, it puts the coil B1 of the relay R1 in connection with the source of current S. The relay R1 comprises, in addition to the coil B1, a moving contact C2 which is capable of occupying either a position of rest 1, or an operative position 2 when the coil B1 is supplied with current. The stud 1 of the position of rest of the contact C2 is connected through a connection 59 to the stud 2 of the switch I2 corresponding to the operative position of the contact C3 of the latter, its position of rest, 1, being connected to ground.

The stud 2 corresponding to the operative position of the contact C2 is connected, through a connection 61, to the switch 26, and self-supply resistors of the relay R1 ensure the connection between, on one hand, the coil B1 and the connection 61 and, on the other hand, the coil B1 and the moving contact C1.

The stud 2 of the anti-attack relay R2 corresponding to the operative position of its moving contact C4, is connected, through a connection 63, to the switch 25. Two self-supply resistors of the relay R2 establish a connection, on one hand, between the coil B2 of the relay R2 and the connection 63 and, on the other hand, between the coil B2 and the contact C3 of the switch I2.

A diode D1 placed in the connection 63 allows the current to travel from R2 to the switch 25, and a second diode D2 ensures a connection between the connection 61 and a point 64 located between the diode D1 and the switch 25 while opposing the passage of the current from the point 64 to the connection 61. The coil 32 (52) is connected in series with the coil B2 through a connection 65 in which are inserted an "open door" safety switch 66 and a diode D3.

The switch 66, associated with the fork member 3 in the known manner, is open when the door is closed, i.e. in the position shown in FIGS. 1 and 3, and closed when the door is opened. The diode d3 permits the coil B2 to be shorted through the switch 66 when it is closed.

A connection 67 connects the relay R1 and the connection 61 to the switch 26.1 associated with the interior opening control for the rear door (FIG. 7), this switch and a switch 25.1 associated with the exterior control of the rear door being connected in parallel with a coil 32.1 (or 52.1) connected to ground. A diode D4 is placed in the connection 62 between the switch 25.1 and the relay R2 so as to allow the passage of the current only from R2 to the switch 25.1. A diode D6 is placed in the connection 67 between the switch 26.1 and the relay R.1 to allow the passage of the current from the latter to the switch 26.1, and a diode D5 connects a point 69 of the connection 67, located upstream of the diode D6, to a point 71 of the connection 62 located between the diode D4 and the switch 25.1. The switches 25.1 and 26.1 are connected in parallel to a coil 32.1 or 52.1 as shown in FIG. 6.

The electric deactivating circuit shown in FIG. 6 operates in the following manner:

(a) "Anti-attack" deactivation.

The object is to deactivate solely the exterior opening control of the door (slide 18, FIGS. 1 and 3). The user depresses the internal anti-attack button which places the contact C3 in its operative position 2. The anti-theft relay R1 has its contact C2 in position 1 and therefore a direct current from the source S passes therethrough and supplies current to the coil B2. The contact C4 consequently switches to the operative position 2.

The safety switch 66 is opened when th door is closed.

If under these conditions an attacker attempts to open the door from the exterior, this attempt causes, as explained with reference to FIGS. 1 to 5, the closure of the contact 25 and therefore the supply of current to the coil 32 (52) and the automatic release of the control lever 12 or 41 from the catch 9, which prevents the opening of the door.

(b) "Anti-theft" deactivation.

With the circuit in its initial position shown in FIG. 6, the user causes the switching of the switch C1 from its inoperative position 1 to its operative position 2 by means of the coded key 57 or the remote control 58. The coil B1, supplied with current, causes the moving contact C2 to switch to its operative position 2. Current can therefore be supplied to the switch 26 and also to the switch 25 through the diode D2, the diode D1 preventing the passage of the current to the relay R2.

If an attempt to open the door in an unauthorized manner then occurs, either from the exterior or from the interior, the corresponding switch 25, 26 closes and the coil 32 (52) is supplied with current and causes, as already explained, the automatic release of the control lever 12,41 relative to the catch 9.

As a modification, the two switches 25, 26 may be connected to an indicator lamp 50 (LED) through two diodes D7, D8, the lamp 50 being lit up when one of the contacts 25, 26 is rendered active.

(c) Safety device for preventing an untimely anti-attack deactivation.

If the user leaves his vehicle and leaves his keys inside and forgets to close the door, an anti-attack deactivation of the doors would prevent him from entering his vehicle after accidentally closing the door which remained open.

In order to avoid this risk, a diode D3 is placed between the coil B2 of the relay R2 and the safety switch 66, this diode D3 allowing the passage of the current from B2 to the switch 66.

Thus, if the front door controlling by this circuit remains open, the switch 66 is consequently closed and connects the coil B2 of the relay R2 to ground through the diode D3. If the reversing switch I2 is then placed in the operative position 2 by depressing the corresponding button, no current passes through the coil B2 so that the switch C4 cannot switch to the operative position 2 and the exterior control switch 25 cannot be supplied with current.

Operation of the deactivating circuit shown in FIG. 7 (rear door)

This circuit is provided with a connection 70 supplied with current and equipped with a "child" safety switch 60 and connected to the interior control switch 26.1 at a point located between the latter and the diode D6. When the safety switch 6 is closed, the interior control switch 26.1 is supplied with current, but not the exterior control witch 25.1 owing to the interposition of the diode D6 which opposes the passage of the current to the diode D5. An attempt on the part of a child to open the rear door by means of its interior control causes therefore the closure of the switch 26.1 and the automatic release of the control lever 12 or 41 from the catch 9, as previously described.

The following table recapitulates the three possible modes of deactivation described hereinbefore for the front and rear doors of a vehicle.

| | Front door | Rear door |
|---|---|---|
| Anti-attack | EOC | EOC |
| Child safety | — | IOC |
| Anti-theft | EOC + IOC | EOC + IOC |

EOC = exterior opening control.
IOC = interior opening control.

The scope of the invention is not intended to be limited to the described embodiments and may encompass variants. The electric circuit for deactivating shown in FIGS. 6 and 7 may in particular be modified by replacing the described means by any equivalent means performing the same deactivating functions. The relays R1 and R2 may be controlled either by self-supply through the illustrated resistors or by an electronic memory in the known manner.

Moreover, it will be appreciated that the case 5 may include the mechanisms of the fork member 3, of the catch 9, of the lever 12, 39, of the slides 18, 19 and of the switches 25, 26 so as to render the assembly mechanically and electrically impossible to pick or tamper with.

Furthermore, an alarm may be associated with the electric control circuit.

The invention is applicable not only to vehicle doors, but also more generally to any opening element associated with a latch or a fastener whose structure is of the type described hereinbefore. This is the case of a number of latches for luggage boots or compartments, hoods or bonnets, glove boxes, sliding roofs of vehicles in which the right to open is obtained by the actuation of an unlocking lever which may be prevented by the means provided by the invention.

I claim:

1. An assembly of a door latch and a device for deactivating said latch, in particular for a vehicle door, in which assembly the latch comprises a keeper for fixing on a frame of the door, a latch case, a fork member pivotally mounted in the latch case in which fork member is provided an opening for receiving said keeper, said fork member being provided with two branches for retaining the keeper therebetween, a catch pivotally mounted on the latch case and capable of being placed in a position for locking the fork member onto the keeper for maintaining the door closed, means for shifting the catch and permitting the locking and unlocking of the fork member and capable of being rendered inoperative by the deactivating device, wherein:

(a) the catch shifting means comprise a control lever, at least one manual control system for said lever connected to said lever to permit the shifting of the catch for the locking of the latch, and an electromechanism capable of maintaining the control lever coupled in rotation with the catch so long as said electromechanism is not supplied with electric current and capable of releasing the lever relative to the catch when the electromechanism is supplied with current;

(b) the deactivating device comprises a centralized electric control circuit associated with the manual control system for the lever and in which control circuit are inserted at least one switch capable of being closed by an approach travel of said control system, and the electromechanism, which is provided with means for automatically releasing the lever relative to the catch, said means for releasing being actuated after activation of the electric deactivating circuit by a closure of said switch which supplies current to the electromechanism, and means for automatically producing said closure of said switch by a manual attempt to actuate the control system for the lever.

2. An assembly according to claim 1, intended in particular for a vehicle door, said assembly comprising two manual control systems for the control lever which are respectively exterior and interior relative to the door, each manual control system being provided with a slide in which slide is provided an elongated opening through which opening an end portion of said control lever extends, an exterior control switch and an interior control switch respectively cooperative with a respective end of the slides arranged in such manner that, in the position of rest of the slides, the exterior and interior control switches are open and no current can therefore flow through the electromechanism which then maintains the control lever coupled in rotation with the catch, and the actuation of one of the slides causes the closure of the corresponding control switch and consequently, when said control switch is supplied with current, the automatic release by the electromechanism of the control lever relative to the catch, it then being no longer possible to open the latch.

3. An assembly according to claim 2, wherein the control lever and the catch are pivotally mounted on the latch case on a common pivot pin, and the electromechanism comprises a coil, a plunger axially slidable in the coil, the lever and the catch being respectively provided with an opening which openings are in alignment with each other, an elastically yieldable return element associated with the plunger for biasing the plunger into said aligned openings when the coil is not supplied with current, supply of current to the coil subsequent to the closure of one of said control switches causing the magnetic retraction of the plunger into said coil and consequently the extraction of the plunger from said aligned openings and the release of the control lever relative to the catch.

4. An assembly according to claim 2, comprising two links, an articulation pin articulating ends of said links together to form a toggle, the control leverl for the catch having two branches substantially in an L configuration and pivotally mounted at a junction of said branches of said lever on the latch case, one of said branches being engaged in said elongated openings of said slides, the other branch of said lever being articulated at one end to a first link of said two links, and a second link of said two links being articulated to the catch at an end of the second link opposed to said articulation pin, the electromechanism comprising a coil, a magnetic core disposed within said coil and a magnet fixed on one of said two links in confronting relation to the core and coil with poles of the same sign in confronting relation to each other so that, when current is supplied to the coil, the magnet is urged by the magnetic core and causes the pivoting of said two links about said articulation pin and consequently the release of the control lever relative to the catch, whereas, when the coil is not supplied with current, said two links of said toggle are maintained in the extension of each other by the magnet, which is attracted by the core, and couple the control lever with the catch.

5. An assembly according to claim 2, wherein the electric deactivating circuit comprises, connected to a DC power supply: a first anti-theft reversing switch capable of being switched by a control means, namely selectively a coded manual key or a remote control, an anti-theft deactivating relay, a second anti-attack reversing switch and an anti-attack relay, the switch associated with the exterior control, the electromechanism, all these elements being connected in series, the electromechanism being connected, on one hand, to the switch associated with the exterior control and, on the other hand, with the anti-attack relay which is connected to be supplied with current by means of the anti-theft relay when a moving contact of the anti-theft relay is in a position of rest and said anti-attack switch is actuated.

6. An assembly according to claim 5, wherein the switch associated with the interior control is connected in parallel with the exterior control switch to the electromechanism and to the anti-theft relay, and a first diode is interposed between the exterior control switch and the anti-attack relay so as to allow the passage of current from the anti-attack relay to the exterior control switch, a second diode being connected to an output of the first diode and to the interior control switch so as to prevent the supply of current to the interior control switch by the anti-attack relay, but, on the contrary, allow current to be supplied to the switch associated with the exterior control by the anti-theft relay when the anti-theft relay is activated by the closure of the anti-theft switch, the first diode then preventing the passage of current to the anti-attack relay.

7. An assembly according to claim 6, wherein an "open door" safety switch associated with the fork member is interposed between the electromechanism of the door and the corresponding anti-attack relay, and a diode is placed between the anti-attack relay and said "open door" switch so that, when said front door is opened, the safety switch is closed and consequently connects a coil of the anti-attack relay to ground.

8. An assembly according to claim 5, further comprising an electric deactivation circuit for a second door, in particular a rear vehicle door, the anti-theft and anti-attack deactivating relays being also connected to said electric deactivating circuit for said second door, and said deactivating circuit of the second door comprising an electromechanism, two switches associated with the exterior and interior controls and diodes connected therebetween to permit as desired an anti-attack deactivation or an anti-theft deactivation of said second door.

9. An assembly according to claim 8, wherein the deactivating circuit of the second door is provided with "child safety" means for deactivating the interior control of said second door.

10. An assembly according to claim 9, wherein said "child safety" means comprise a "child" safety switch connected to the interior control switch and a fourth diode interposed between a connection of said child safety switch with the interior control switch and the second diode so as to prevent the passage of current to the second diode and to the exterior control switch.

11. An assembly according to claim 1, wherein the latch case encloses all the following elements: the mechanisms of the fork member, the catch, the lever, the slides and the switches so as to render it impossible to mechanically and electrically tamper with the assembly.

* * * * *